US005790010A

United States Patent [19]

Schwab

[11] Patent Number: 5,790,010

[45] Date of Patent: Aug. 4, 1998

[54] MEANS FOR ACTUATING A SNAP-ACTING M-BLADE

[76] Inventor: Pierre P. Schwab, 1768 SE. Clearmont St., Port St. Lucie, Fla. 34983

[21] Appl. No.: 799,693

[22] Filed: Feb. 11, 1997

[51] Int. Cl.[6] ..... H01H 37/54

[52] U.S. Cl. ..... 337/365; 337/342; 337/349; 200/451; 200/447; 200/407

[58] Field of Search ..... 337/365, 342, 337/343, 345, 346, 349, 371, 372, 375, 347, 57; 200/283, 290, 401, 402, 405, 407, 409, 468

[56] References Cited

U.S. PATENT DOCUMENTS

| | | | |
|---|---|---|---|
| 3,213,228 | 10/1965 | Burch et al. | 200/67 |
| 4,032,734 | 6/1977 | Burch | 200/67 |
| 4,145,587 | 3/1979 | Purssell | 200/67 |
| 4,424,506 | 1/1984 | Burch | 337/365 |
| 4,669,182 | 6/1987 | Ferroni et al. | 29/622 |
| 4,796,355 | 1/1989 | Burch et al. | 29/622 |
| 5,555,972 | 9/1996 | Schwab . | |

OTHER PUBLICATIONS

"Tiny Spring Improves Thermostat"; Design News; Author: R. N. Boggs; pp. 96, 97; Published Apr. 8, 1991; Newton, MA 02158.

"Thermal Projectors Trip in Less Than 1 m sec;" Design News; Author: R.N. Boggs; pp. 127, 128; Published Oct. 21, 1991; Newton, MA 02158.

"Thermostat Packaging Adds Design Flexibility;" EDN; Author: Ann Watson Swager; pp. 63, 65, 66, 68; Pub Sep. 28, 1989; Highlands Ranch, CO 80126–2329.

*Primary Examiner*—Leo P. Picard
*Assistant Examiner*—Anatoly Vortman
*Attorney, Agent, or Firm*—Robert J. Harter

[57] ABSTRACT

An electrical switch incorporating a snap-acting M-blade is actuated by a lever requiring a low actuation force and is actuated by a bridge engaging a critical region of the M-blade's double-loop end to provide an extremely low differential. Together, the means for actuating cover a broad range of applications. Additional features include a snap-acting M-blade actuated by a second snap-acting device, and the lever comprising an integral tab that serves as a pivot point.

25 Claims, 7 Drawing Sheets

MEANS FOR ACTUATING A SNAP-ACTING M-BLADE

BACKGROUND OF THE INVENTION

1. Field Of The Invention

The subject invention generally pertains to temperature and pressure responsive snap-acting switches and more specifically to novel means for actuating them.

2. Description Of Related Art

Heretofore it has been well known to provide overcenter snap springs for electrical control devices such as thermostats and switches. Burch U.S. Pat. Nos. 3,213,228; 4,032,734; 4,424,506; 4,796,355; and Schwab U.S. Pat. No. 5,555,972 (all of which are specifically incorporated by reference herein) disclose how to stress a flat M-shaped spring member (M-blade) to become snap acting by spreading the inner legs of its U-shaped loops with an actuating member, thus side-stressing the planar spring member thereby causing it to become snap-acting and bistable.

The applicant of the present invention has designed, used, and reduced to practice and commercialized numerous products using the M-blade for over 15 years and has become expert at Burch M-blade technology in the process. As a result of this work, the inventor of the present application has made numerous additional improvements, discoveries, and observations which greatly reduce the cost of producing snap-switch products and expand the usefulness and scope of application. In particular, the present invention relates to new methods for operating and actuating the M-blade spring element to cause it to snap overcenter and relates to means for constructing M-blade snap-acting switches with very low actuating forces (15 grams) and fewer moving parts. These improvements, discoveries, and observations are the objects of this application for patent.

One such observation is that typically conventional snap switches comprise two moving parts to complete the electrical connections from a common terminal to the other switch terminals. A contact arm has a spring portion that urges an arm against a hinge member, wherein the hinge member engages the contact arm at one end and engages the switch common terminal at the other to complete the electrical circuit.

Other drawbacks of existing snap-acting devices include inconsistant snap action, sluggish snap action; actuation forces that are relatively high compared to the contact forces; excessively large differentials, i.e., deadband distance the actuator must travel between two states of equilibrium; and travel direction of actuator relative to moving contact being incompatible with established electrical standards of normally open and normally closed terminal locations.

SUMMARY OF THE INVENTION

To avoid the limitations and problems of existing snap-acting switches, it is an object of the invention to provide a bridge actuator that engages a critical region of an M-blade to provide extremely quick snap action at an extremely low differential of 0.001 inches or less.

A second object of the invention is to actuate an M-blade with a lever to provide a contact force that is greater than the actuation force.

A third object is to provide a lever that moves a common electrical contact in the same direction as the actuator in agreement with established electrical standards pertaining to the location of normally open and normally closed terminals.

A fourth object is to provide a temperature responsive switch that is consistently reliable by having a snap-acting disc act upon a snap-acting M-blade.

A fifth object is to provide a temperature responsive switch that is extremely compact by virtue of a bridge straddling a terminal to engage the critical region of an M-blade.

A sixth object is to provide a lever having an integral tab that bends to serve as a pivot.

These and other objects of the invention are provided by an M-blade being actuated by at least one of a lever and a bridge. The bridge engages a critical region in the double-loop end of the M-blade to provide extremely quick snap actuation at an extremely low differential. The lever engages the center legs of an M-blade to provide a contact force greater than the force acting on the lever. The lever includes an integral tab that bends to allow the lever to tilt.

DESCRIPTION OF THE PREFERRED EMBODIMENT

Figure 1:
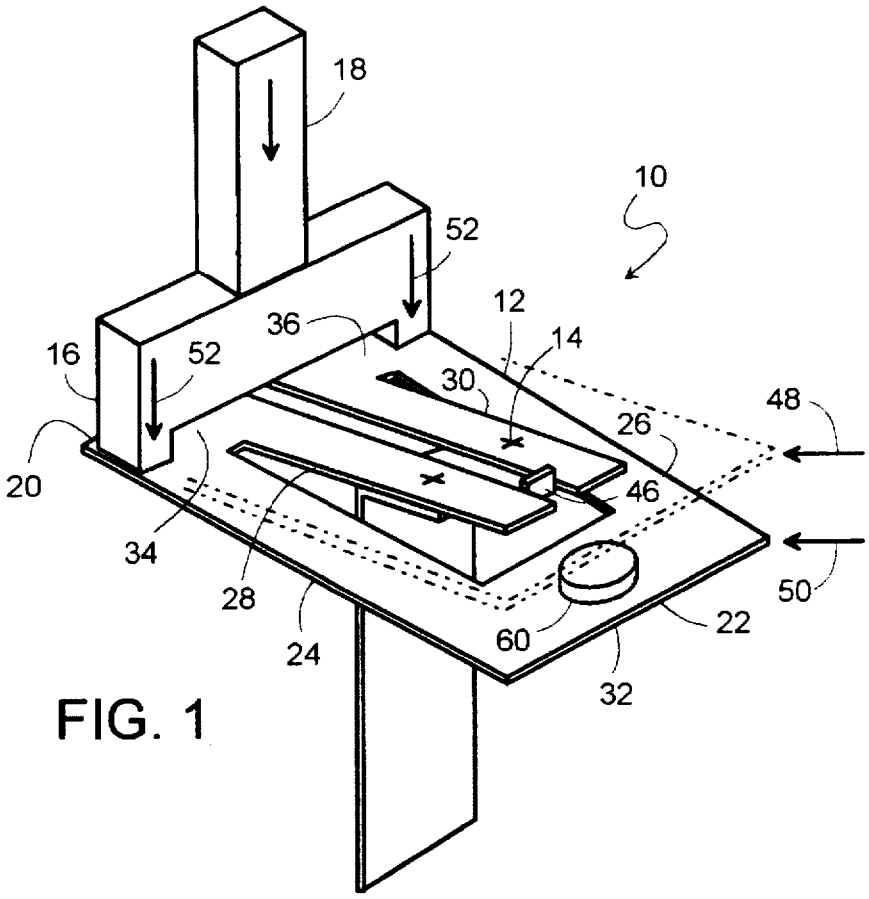
FIG. 1 is a schematic perspective of the invention.

An auto-snap device 10 of FIG. 1 includes a sheet metal spring member 12, an anchor point 14 (e.g., rivet or weld spots), an electrically non-conductive phenolic bridge 16, and an actuator 18. Spring member 12, also shown in FIG. 2, includes a double-loop end 20 opposite a closed end 22, a first outer leg 24, a second outer leg 26, a first inner leg 28, a second inner leg 30, a cross member 32, a first loop 34, and a second loop 36. A first slit 38 extends from cross member 32 to a first termination point 40. A second slit 42 extends to a second termination point 44. Termination points 40 and 44 are specifically defined as two points spaced as far away from each other as possible while remaining within slits 38 and 42, respectively, and being equidistant from cross member 32. To further define their location, points 40 and 44 are spaced as far away as possible from cross member 32 without compromising the aforementioned location criteria.

A tab 46 near anchor point 14 spreads inner legs 28 and 30 apart to distort spring member 12 out of coplanar alignment with itself. This distortion provides spring member 12 with two positions of equilibrium as indicated by arrows 48 and 50. An external force 52 can urge spring member 12 to snap over from one position 48 to the other 50. This rapid snap-over movement from one position to the other is referred to herein and below as "snap action".

Figure 2:
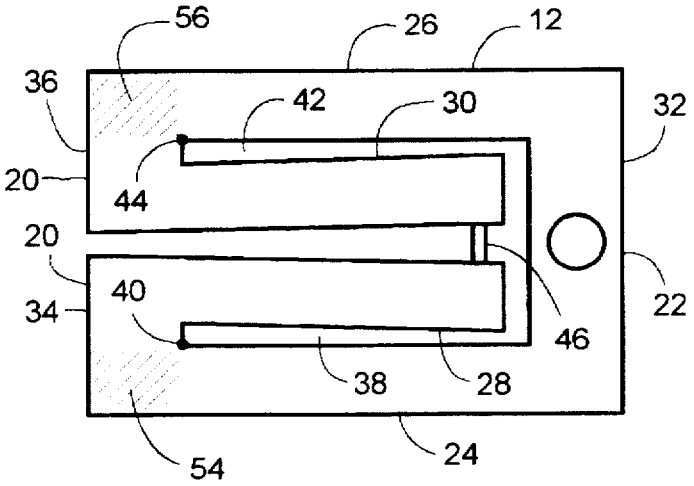
FIG. 2 is the top view of an M-blade with its critical sweet spots being cross-hatched.

For auto-snap device 10 of FIG. 1, external force 52 is provided by bridge 16 acting upon double-loop end 20 with a counteracting force provided at anchor point 14. Bridge 16 makes contact with spring member 12 at two regions each referred to as a "sweet spot". Referring to FIG. 2, sweet spots 54 and 56 are defined as those areas that extend in two orthogonal directions beyond slits 38 and 42, i.e., above and to the left of termination point 44 for sweet spot 56 and below and to the left of termination point 40 for sweet spot 54.

Figure 3:
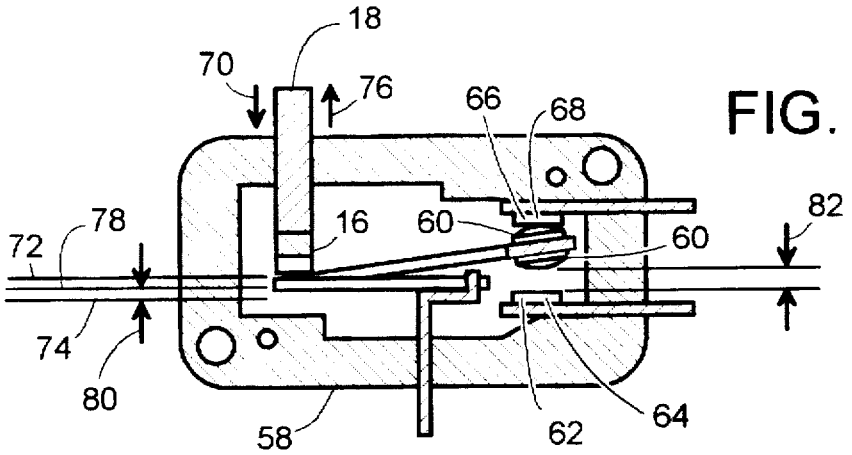
FIG. 3 is a central cross-sectional view of a bridge actuated switch with its moving contact touching a normally closed terminal.
Figure 4:
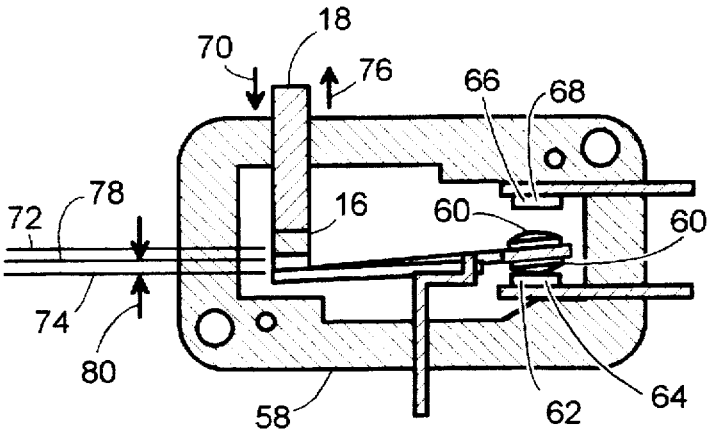
FIG. 4 is the same view as FIG. 3, but with the moving contact touching a normally open terminal.
Figure 5:
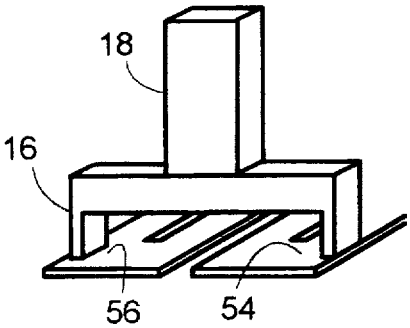
FIG. 5 shows where the bridge engages the M-blade of FIGS. 3 and 4.

The results of applying an actuation force to sweet spots 54 and 56 is best explained with reference to a switch 58 of FIGS. 3, 4 and 5. Switch 58 includes a first electrical contact 60, a first stop 62 serving as a second electrical contact 64 and a second stop 66 serving as a third electrical contact 68. Contact 60 snaps over from contact 68 (see FIG. 3) to contact 64 (see FIG. 4) as bridge 16 (traveling in a positive direction 70 from point 72) reaches a forward trip point 74. Contact 60 snaps back to contact 68 as bridge 16 returns in a negative direction 76 to return trip point 78. The distance between trip points 74 and 78 is referred to a differential 80. When bridge 16 acts upon sweet spots 54 and 56 (as shown in FIG. 5), differential 80 is surprisingly no more than 10 to 20 percent of a predetermined distance 82 that contact 60 travels. Applying an actuation force outside sweet spots 54 and 56 results in undesirably high differentials and sluggish snap action.

Figure 6:
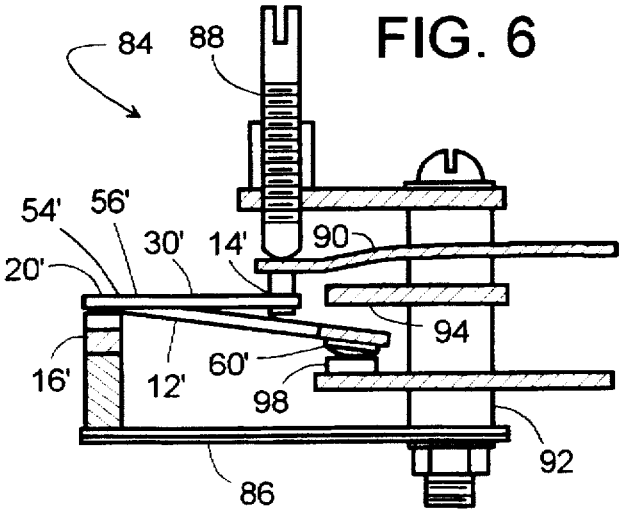
FIG. 6 is a cross-sectional side view of an adjustable, temperature responsive switch having a bridge actuated by a bimetallic arm.

An adjustable oven thermostat 84, shown in FIG. 6, includes an inverted bridge 16' acting upon sweet spots 54' and 56', and actuated by a temperature responsive bimetallic arm 86; spring member 12' with double-loop end 20'; an adjustment screw 88 acting upon anchor point 14'; a leaf spring 90 attached to anchor point 14' and urging its center legs (one being item 30') toward screw 88; and a mounting post 92 that holds screw 88 spring 90, a stop 94, an electrical contact 60', and actuator arm 86. A temperature change causes arm 86 to move bridge 16', which in turn causes spring member 12' to experience a snap action that rapidly moves contact 60' between stop 94 and a contact 98. Adjustment screw 88 determines a temperature threshold at which the snap action occurs.

Figure 7:
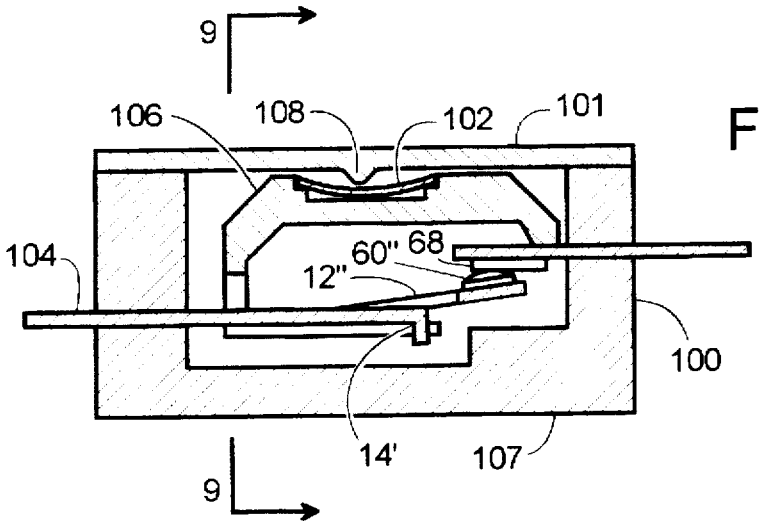
FIG. 7 is a cross-sectional view (taken along line 7—7 of FIG. 9) of a compact switch having two snap-acting elements.
Figure 8:
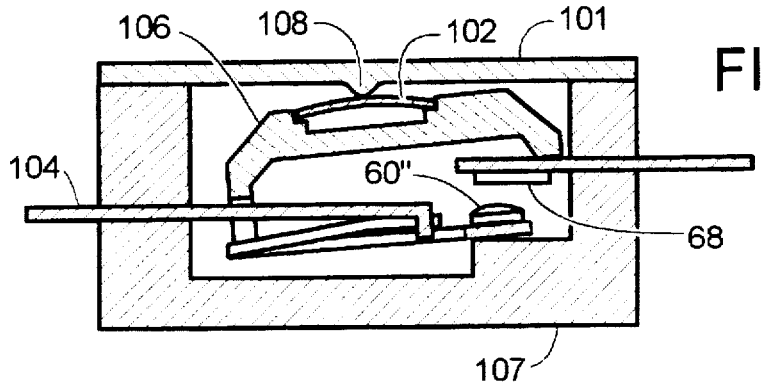
FIG. 8 is the switch of FIG. 7 after being actuated.
Figure 9:
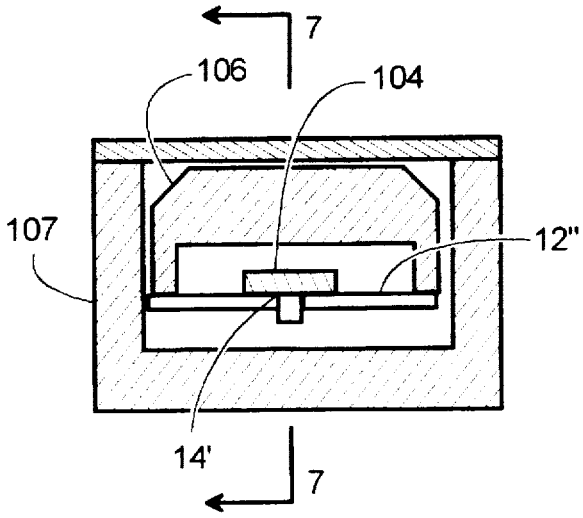
FIG. 9 is a cross-sectional view of FIG. 7 taken along line 9—9.

FIGS. 7, 8 and 9 illustrate an over-temperature switch 100 that includes a thermally conductive cover 101, and two snap action components. Switch 100 includes a spring member 12", providing a first snap action; a bimetallic disc 102, providing a second snap action; an electrical terminal 104 attached to an anchor point 14'; a bridge 106 straddling terminal 104 and made of an electrically insulated material such as a phenolic; and a housing 107.

Disc 102 is a conventional bimetal disc that snaps overcenter upon reaching a temperature limit. The disc serves as a protective device commonly found in a variety of small kitchen appliances. When switch 100 reaches a predetermined temperature limit, disc 102 snaps overcenter. As a result, disc 102 pushes against a protrusion 108 and bridge 106. This causes spring member 12" to snap over to break electrical continuity between contacts 60" and 68, as shown in FIG. 8. As switch 100 cools down, disc 102 and spring member 12" snap back as shown in FIG. 7.

Figure 10:
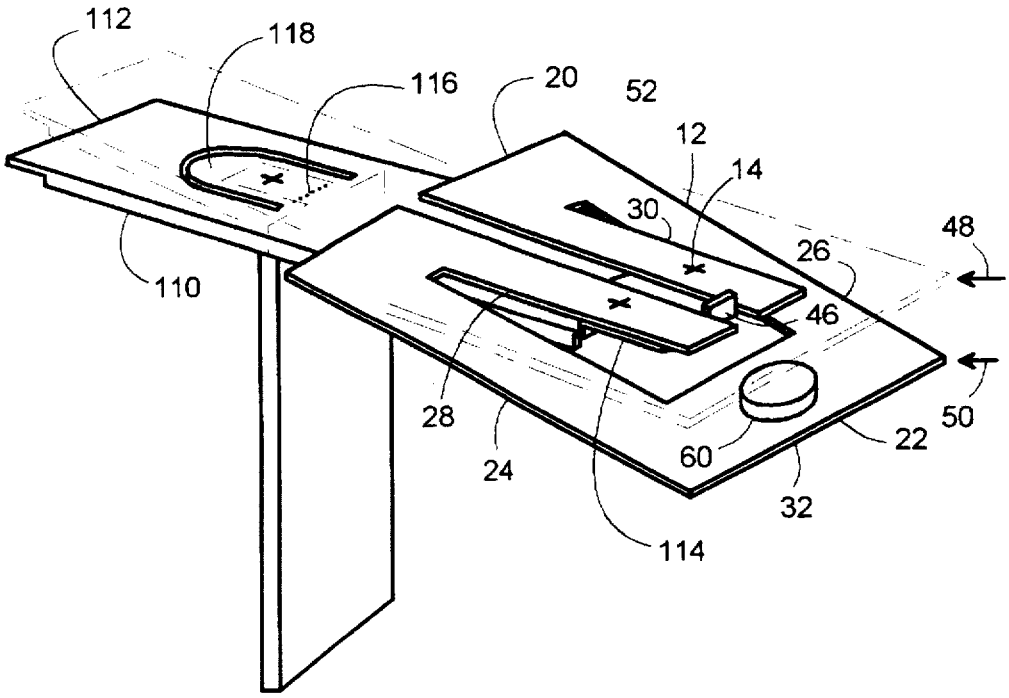
FIG. 10 is a perspective view of a lever actuated M-blade.

In FIG. 10, a lever 110 is coupled to spring member 12 at anchor point 14. Lever 110 has an actuation end 112 opposite a reaction end 114 with a pivot 116 therebetween. In one embodiment of the invention, pivot 116 comprises a sheet metal tab 118 whose bending action allows lever 110 to tilt.

Figure 11:
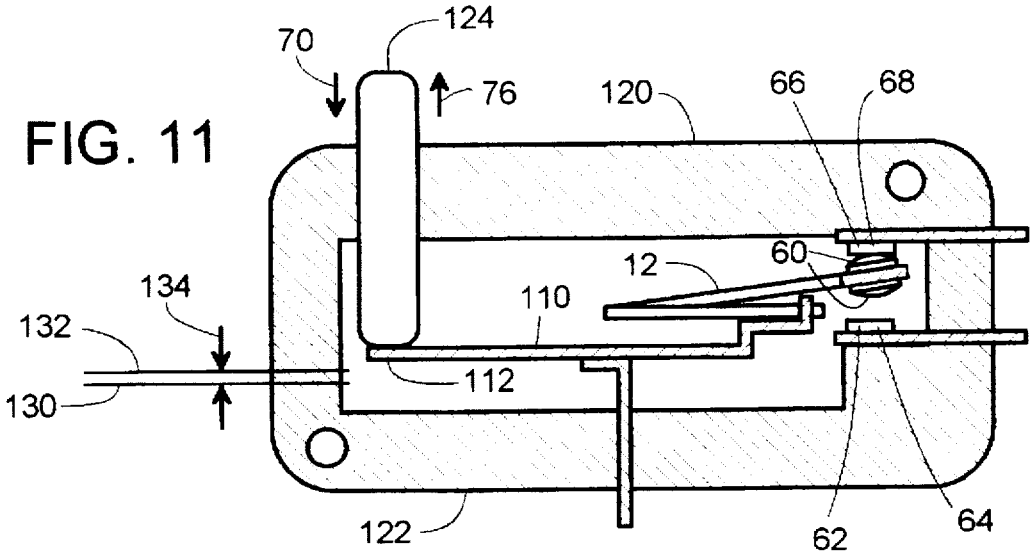
FIG. 11 is a cut-away view of a lever actuated M-blade incorporated in an electrical switch.
Figure 12:
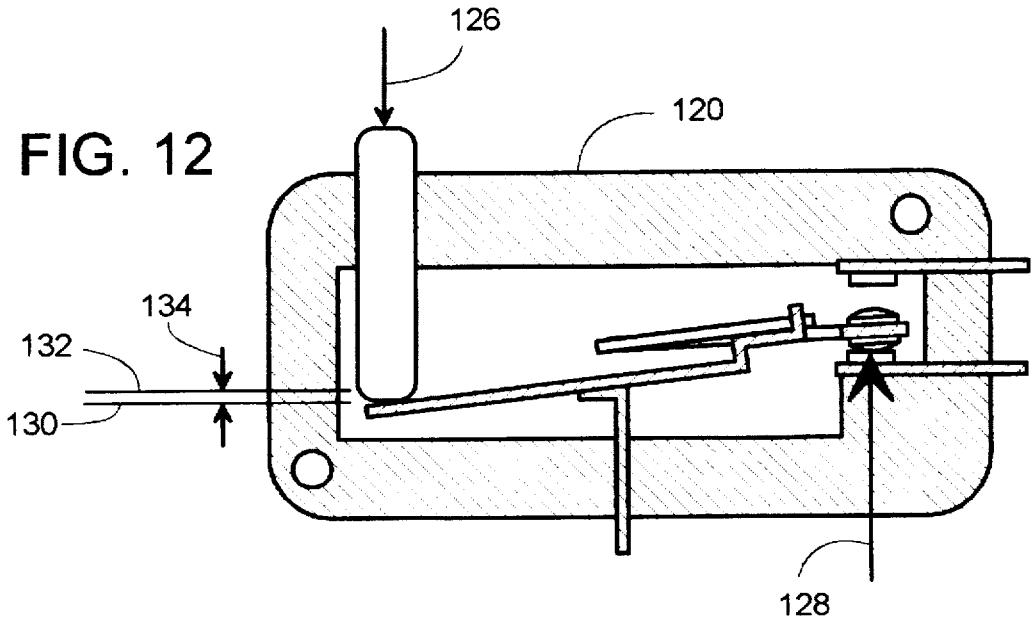
FIG. 12 is the switch of FIG. 11 after being actuated.

When incorporated into a switch 120 within housing 122 as shown in FIG. 11, lever 110 is actuated by an actuating plunger 124. Upon exerting an actuation force 126 against actuation end 112, spring member 12 snaps over to push contact 60 against contact 64 with a contact force 128 (see FIG. 12). Lever 110 is such that contact force 128 is greater than actuation force 126. Switch 120 snaps back, as shown in FIG. 11, upon removing actuation force 126. Plunger 124 and contact 60 both move in generally the same direction, i.e., positive direction 70 and negative direction 76. The timing of the snap action between stops 62 and 66 (or contacts 64 and 68) is determined by a forward trip point 130, a return trip point 132, and differential 134.

Figure 13:
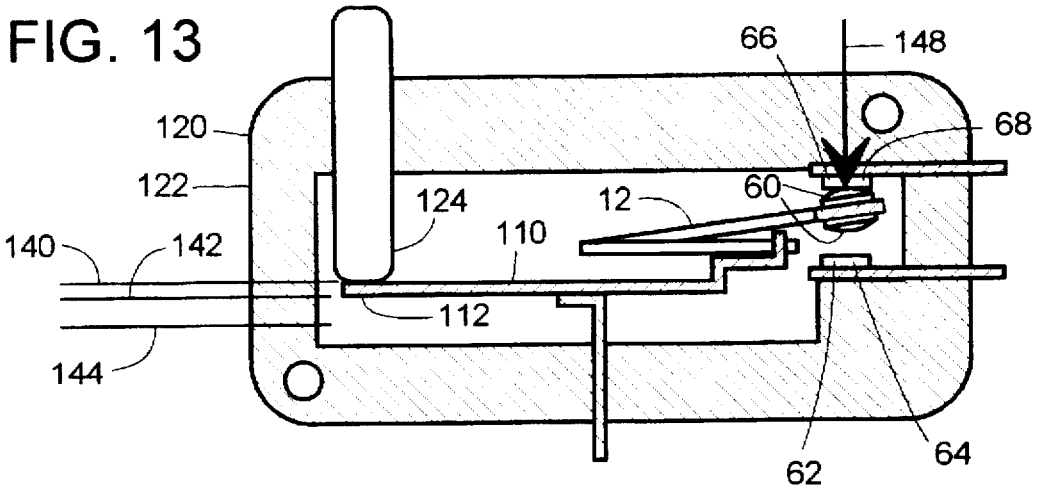
FIG. 13 is the switch of FIG. 11 showing the rest position of its actuator.
Figure 14:
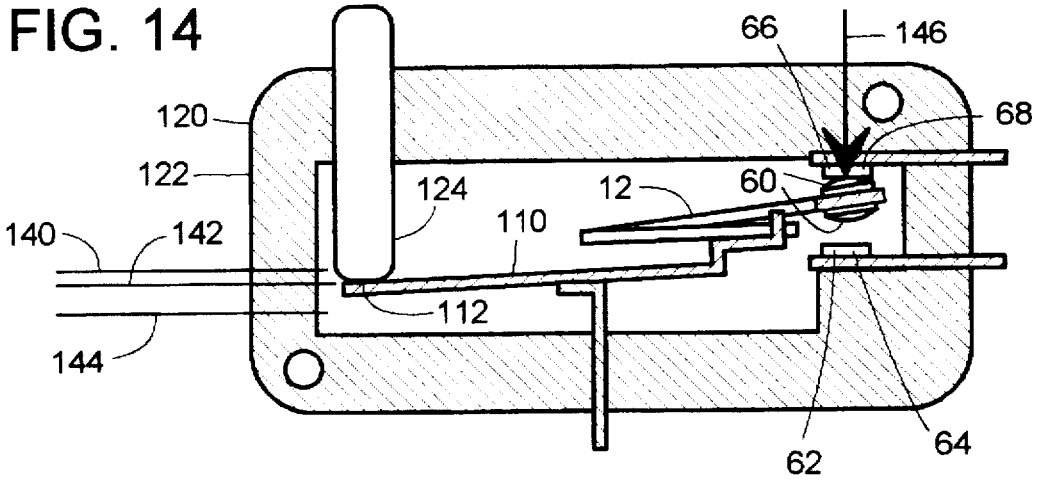
FIG. 14 is the switch of FIG. 11 showing the intermediate position of its actuator.
Figure 15:
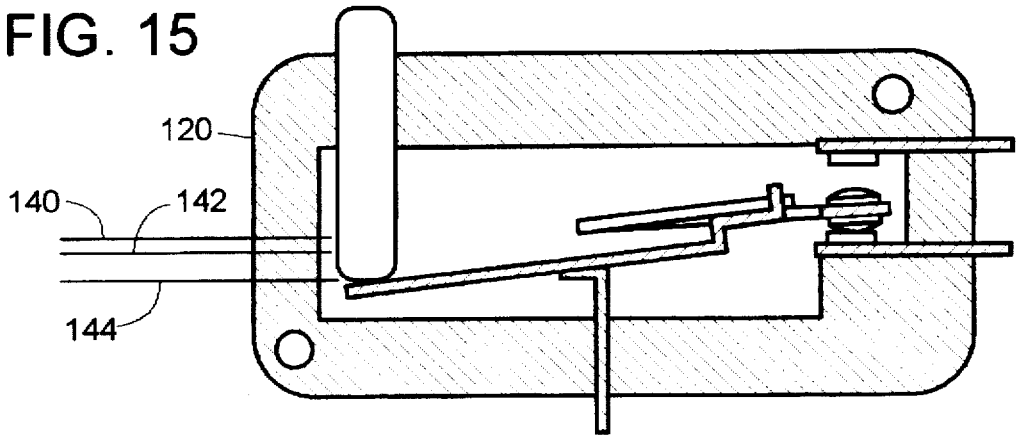
FIG. 15 is the switch of FIG. 11 showing the fully forward position of its actuator.
Figure 16:
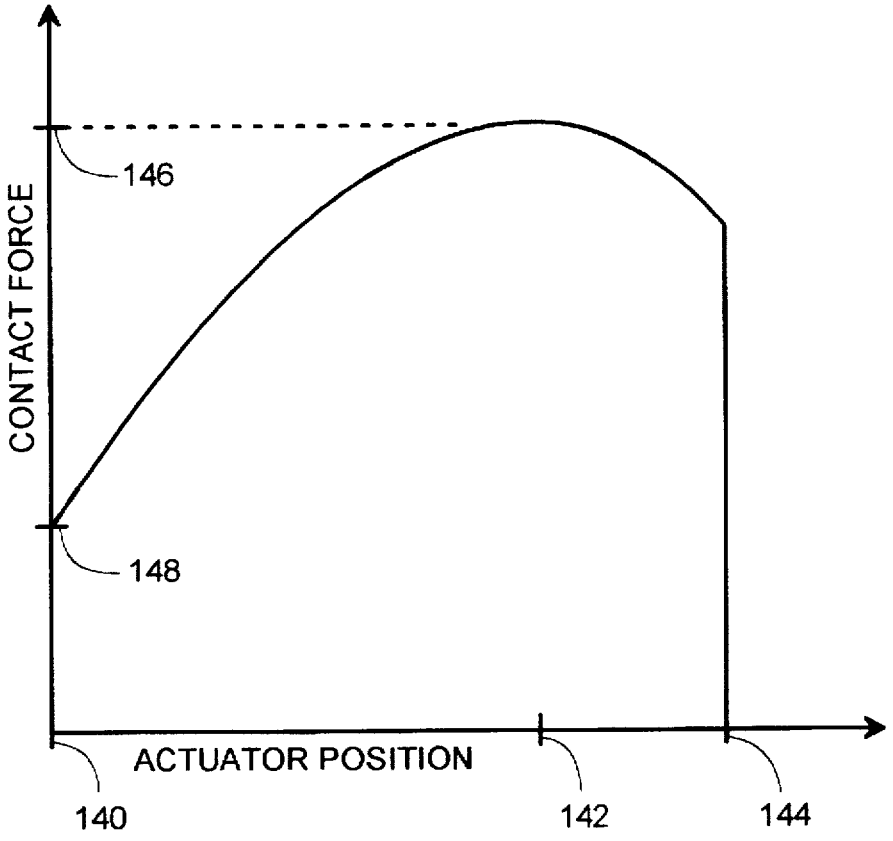
FIG. 16 is a graph showing how the contact force varies as a function of the actuator's position.

Actuator plunger 124 moves from a rest position 140 (FIG. 13), past an intermediate position 142 (FIG. 14), and to a fully forward position 144 (FIG. 15). As it does this, the force contact 60 exerts against contact 68 varies as plotted in FIG. 16. Force 146 at intermediate position 142 is greater than force 148 at rest position 140. The vertical line 150 of FIG. 16 is where switch 120 snaps over to contact 64.

Although the invention is described with respect to a preferred embodiment, modifications thereto will be apparent to those skilled in the art. Therefore, the scope of the invention is to be determined by reference to the claims which follow.

I claim:

1. An auto-snap device, comprising:

a sheet metal spring member having a double-loop end opposite to a closed end, said sheet metal spring member having a first outer leg, a second outer leg, a first inner leg, a second inner leg, and a cross member, said first outer leg being coupled to said second outer leg by way of said cross member at said closed end, said first outer leg coupled to said first inner leg by way of a first loop at said double-loop end to define a first slit between said first outer leg and said first inner leg and longitudinally extending from said cross member and terminating at a first termination point at said first loop, said second outer leg coupled to said second inner leg by way of a second loop at said double-loop end to define a second slit between said second outer leg and said second inner leg and longitudinally extending from said cross member and terminating at a second termination point at said second loop, said first loop including a first sweet spot situated such that said first termination point is between said first sweet spot and said cross member and said first termination point is further situated between said first sweet spot and said second loop, said second loop including a second sweet spot situated such that said second termination point is between said second sweet spot and said cross member and said second termination point is further situated between said second sweet spot and said first loop, said sheet metal spring member being distorted to place said inner legs out of coplanar alignment with said outer legs to provide said sheet metal spring member with a snap action;

an anchor point joining said first inner leg to said second inner leg at a location between said double-loop end and said closed end;

a bridge engaging said first sweet spot and said second sweet spot; and an actuator adapted to move said bridge relative to said anchor point in a positive direction past a forward trip point and in a negative direction past a return trip point, whereby said sheet metal spring member experiences said snap action at said forward trip point and at said return trip point with the distance between said forward trip point and said return trip point being defined as a differential.

2. The auto-snap device of claim 1 further comprising a first electrical contact on said cross member, a second electrical contact, and a stop, said second electrical contact being spaced apart from said stop with said first electrical contact being free to travel a predetermined distance between said second electrical contact and said stop, said predetermined distance being at least five times greater than said differential.

3. The auto-snap device of claim 1 wherein said predetermined distance is at least ten times greater than said differential.

4. The auto-snap device of claim 2 wherein said actuator includes temperature responsive bimetallic material.

5. The auto-snap device of claim 4 further comprising an adjustment screw acting upon said anchor point, and a spring attached to said anchor point and opposing said adjustment screw.

6. The auto-snap device of claim 5 further comprising a mounting post that holds said screw, said spring, said stop, said second electrical contact, and said actuator.

7. The auto-snap device of claim 1 wherein said actuator is a bimetallic disc providing a second snap action in response to temperature.

8. The auto-snap device of claim 7 wherein said bridge is made of an electrically insulated material.

9. The auto-snap device of claim 7 further comprising an electrical terminal attached to said anchor point and said bridge straddles said electrical terminal.

10. The auto-snap device of claim 7 further comprising a housing that contains said sheet metal spring member, said housing having a protrusion that extends toward a central portion of said bimetallic disc.

11. An auto-snap device, comprising:

a sheet metal spring member having a double-loop end opposite to a closed end, said sheet metal spring member having a first outer leg, a second outer leg, a first inner leg, a second inner leg, and a cross member, said first outer leg being coupled to said second outer leg by way of said cross member at said closed end, said first outer leg coupled to said first inner leg by way of a first loop at said double-loop end to define a first slit between said first outer leg and said first inner leg and longitudinally extending from said cross member and terminating at a first termination point at such first loop, said second outer leg coupled to said second inner leg by way of a second loop at said double-loop end to define a second slit between said second outer leg and said second inner leg and longitudinally extending from said cross member and terminating at a second termination point at said second loop, said first loop including a first sweet spot situated such that said first termination point is between said first sweet spot and said cross member and said first termination point is further situated between said first sweet spot and said second loop, said second loop including a second sweet spot situated such that said second termination point is between said second sweet spot and said cross member and said second termination point is further situated between said second sweet spot and said first loop, said sheet metal spring member being distorted to place said inner legs out of coplanar alignment with said outer legs to provide said sheet metal spring member with a snap action;

an anchor point joining said first inner leg to said second inner leg at a location between said double-loop end and said closed end;

a bridge engaging said first sweet spot and said second sweet spot;

an actuator adapted to move said bridge relative to said anchor point in a positive direction past a forward trip point and in a negative direction past a return trip point, whereby said sheet metal spring member experiences said snap action at said forward trip point and at said return trip point with the distance between said forward trip point and said return trip point being defined as a differential;

a first electrical contact on said cross member;

a second electrical contact; and a stop spaced apart from said second electrical contact with said first electrical contact being free to travel a predetermined distance between said second electrical contact and said stop, said predetermined distance being at least ten times greater than said differential.

12. The auto-snap device of claim 11, further comprising a temperature responsive bimetallic material incorporated into said actuator; an adjustment screw acting upon said anchor point; a spring attached to said anchor point and opposing said adjustment screw; and a mounting post holding said screw, said spring, said stop, said second electrical contact, and said actuator.

13. The auto-snap device of claim 11, wherein said actuator is a bimetallic disc providing a second snap action in response to temperature, and wherein said bridge is made of an electrically insulated material.

14. The auto-snap device of claim 13 further comprising an electrical terminal attached to said anchor point and said bridge straddles said electrical terminal.

15. The auto-snap device of claim 13 further comprising a housing that contains said sheet metal spring member, said housing having a protrusion that extends toward a central portion of said bimetallic disc.

16. An auto-snap device comprising:

a sheet metal spring member having a double-loop end opposite to a closed end, said spring member having a first outer leg, a second outer leg, a first inner leg, a second inner leg, and a cross member, said first outer leg being coupled to said second outer leg by way of said cross member at said closed end, said first outer leg coupled to said first inner leg by way of a first loop at said double-loop end to define a first slit between said first outer leg and said first inner leg and longitudinally extending from said cross member and terminating at a first termination point at said first loop, said second outer leg coupled to said second inner leg by way of a second loop at said double-loop end to define a second slit between said second outer leg and said second inner leg and longitudinally extending from said cross member and terminating at a second termination point at said second loop, said sheet metal spring member being distorted to place said inner legs out of coplanar alignment with said outer legs to provide said sheet metal spring member with a snap action;

an anchor point joining said first inner leg to said second inner leg at a location between said double-loop end and said closed end;

a lever having an actuation end opposite a reaction end with a pivot situated therebetween, said reaction end being coupled to said anchor point; and an actuator acting upon said actuation end to move said actuation end relative to said pivot in a positive direction past a forward trip point and in a negative direction past a return trip point, whereby said sheet metal spring member experiences said snap action at said forward trip point and said return trip point with the distance between said forward trip point and said return trip point being defined as a differential.

17. The auto-snap device of claim 16 further comprising a housing coupled to said pivot; a first electrical contact on said cross member; a first stop attached to said housing; and a second stop attached to said housing with one of said first stop and said second stop serving as a second electrical contact, said first electrical contact moving from said first stop to said second stop upon said actuator applying an actuation force against said actuation end, said actuation force being less than a contact force with said contact force being that force which is exerted by said first electrical contact against said second electrical contact when said first electrical contact is against said second electrical contact.

18. The auto-snap device of claim 17 whereby said first electrical contact moves in substantially the same direction as said actuation end.

19. The auto-snap device of claim 18 further comprising a third electrical contact wherein said first stop serves as said second electrical contact and said second stop serves as said third electrical contact.

20. The auto-snap device of claim 16 wherein said pivot enables said lever to tilt by way of a bending action.

21. An auto-snap device comprising:

a sheet metal spring member having a double-loop end opposite to a closed end, said spring member having a first outer leg, a second outer leg, a first inner leg, a second inner leg, and a cross member, said first outer leg being coupled to said second outer leg by way of said cross member at said closed end, said first outer leg coupled to said first inner leg by way of a first loop at said double-loop end to define a first slit between said first outer leg and said first inner leg and longitudinally extending from said cross member and terminating at a first termination point at said first loop, said second outer leg coupled to said second inner leg by way of a second loop at said double-loop end to define a second slit between said second outer leg and said second inner leg and longitudinally extending from said cross member and terminating at a second termination point at said second loop, said sheet metal spring member being distorted to place said inner legs out of coplanar alignment with said outer legs to provide said sheet metal spring member with a snap action;

an anchor point joining said first inner leg to said second inner leg at a location between said double-loop end and said closed end;

a lever having an actuation end opposite a reaction end with a pivot situated therebetween, said reaction end being coupled to said anchor point;

an actuator acting upon said actuation end to move said actuation end relative to said pivot in a positive 30 direction past a forward trip point and in a negative direction past a return trip point, whereby said sheet metal spring member experiences said snap action at said forward trip point and said return trip point with the distance between said forward trip point and said return trip point being defined as a differential;

a housing coupled to said pivot;

a first electrical contact on said cross member;

a first stop attached to said housing; and a second stop attached to said housing with one of said first stop and said second stop serving as a second electrical contact, said first electrical contact moving down from said first stop to said second stop when said actuation end moves down upon said actuator applying an actuation force downward against said actuation end, said actuation force being less than a contact force with said contact force being that force which is exerted by said first electrical contact against said second electrical contact when said first electrical contact is against said second stop.

22. The auto-snap device of claim 21 further comprising a third electrical contact wherein said first stop serves as said second electrical contact and said second stop serves as said third electrical contact.

23. The auto-snap device of claim 21 wherein said pivot enables said lever to tilt by way of a bending action.

24. An auto-snap device comprising:

a housing;

a first stop coupled to said housing;

a second stop coupled to said housing and spaced apart from said first stop;

a first electrical contact moveable between said first stop and said second stop;

a second electrical contact on one of said first stop and said second stop, said first electrical contact selectively engaging and disengaging said second electrical contact as said first electrical contact moves between said first stop and said second stop; and an actuator having a rest position, a fully forward position, and an intermediate position therebetween, said actuator being coupled to said first electrical contact such that said first electrical contact pushes with a first force toward said first stop when said actuator is at said rest position, said first electrical contact pushes with a second force toward said second stop when said actuator is at said fully forward position, and said first electrical contact pushes with a third force toward said first stop when said actuator is at said intermediate position, said third force being greater than said first force.

25. The auto-snap device of claim 24 further comprising:

a sheet metal spring member having a double-loop end opposite a closed end, said spring member having a first outer leg, a second outer leg, a first inner leg, a second inner leg, and a cross member, said first outer leg being coupled to said second outer leg by way of said cross member at said closed end, said first outer leg coupled to said first inner leg by way of a first loop at said double-loop end to define a first slit between said first outer leg and said first inner leg and longitudinally extending from said cross member and terminating at a first termination point at said first loop, said second outer leg coupled to said second inner leg by way of a second loop at said double-loop end to define a second slit between said second outer leg and said second inner leg and longitudinally extending from said cross member and terminating at a second termination point at said second loop, said sheet metal spring member being distorted to place said inner legs out of coplanar alignment with said outer legs to provide said sheet metal spring member with a snap action, said first electrical contact being disposed on said cross member;

an anchor point joining said first inner leg to said second inner leg at a location between said double-loop end and said closed end; and a lever having an actuation end opposite a reaction end with a pivot situated therebetween, said reaction end being coupled to said anchor point, said actuation end engaging said actuator, said actuator acting upon said actuation end to move said actuation end relative to said pivot in a positive direction past a forward trip point and in a negative direction past a return trip point, whereby said sheet metal spring member experiences said snap action at said forward trip point and said return trip point with the distance between said forward trip point and said return trip point being defined as a differential.

* * * * *